US011788209B2

(12) United States Patent
Guardiani et al.

(10) Patent No.: US 11,788,209 B2
(45) Date of Patent: Oct. 17, 2023

(54) COMPACT MODULE FOR THE WET SPINNING OF CHEMICAL FIBRES

(71) Applicant: M.A.E. S.p.A., Piacenza (IT)

(72) Inventors: Valter Guardiani, Piacenza (IT); Paolo Delledonne, Piacenza (IT); Fiorenzo Rasparini, Piacenza (IT); Alfredo Tanzi, Piacenza (IT); Paola Gandolfi, Piacenza (IT); Marco Rovellini, Piacenza (IT)

(73) Assignee: M.A.E. S.p.A., Piacenza (IT)

( * ) Notice: Subject to any disclaimer, the term of this patent is extended or adjusted under 35 U.S.C. 154(b) by 84 days.

(21) Appl. No.: 17/198,497

(22) Filed: Mar. 11, 2021

(65) Prior Publication Data

US 2021/0285130 A1 Sep. 16, 2021

(30) Foreign Application Priority Data

Mar. 11, 2020 (IT) ..... 102020000005230

(51) Int. Cl.
*D01D 5/16* (2006.01)
*D01D 5/06* (2006.01)

(52) U.S. Cl.
CPC ..... *D01D 5/16* (2013.01); *D01D 5/06* (2013.01)

(58) Field of Classification Search
CPC .. D01D 5/16; D01D 5/06; D01D 5/12; D01D 5/098
See application file for complete search history.

(56) References Cited

U.S. PATENT DOCUMENTS 2,108,285 A * 2/1938 Forrest ..... D01D 4/00 68/9
2,532,326 A * 12/1950 Naumann ..... D01D 5/06 425/68
2,780,347 A * 2/1957 Givens ..... D01D 10/0463 242/364.11
3,066,007 A * 11/1962 Brown ..... D01D 10/06 425/71
3,574,811 A * 4/1971 Jamison ..... D01D 5/12 264/290.7
3,851,036 A * 11/1974 Tzentis ..... B01D 71/42 264/209.5
5,670,105 A * 9/1997 Reinehr ..... D01D 5/16 264/235.6
5,762,840 A * 6/1998 Tsai ..... D02J 1/22 264/210.4

(Continued)

FOREIGN PATENT DOCUMENTS

WO WO2013/014576 A1 * 1/2013

*Primary Examiner* — Emmanuel S Luk
(74) *Attorney, Agent, or Firm* — Bay State IP, LLC

(57) ABSTRACT

Compact module for wet spinning of chemical fibres of the type comprising a spinning head (F) of 2-8 tows (S), each one consisting of a plurality of continuous filaments, relative supply pumps (P) of the spinning solution, a coagulation tank (V) containing a coagulation solution, and a plurality of drive rollers (2) and respective idle diverter rollers (3) which determine a zigzag path of the tows (S) downstream of the spinning area, in the rectilinear lengths of which liquid-based treatments are carried out on said tows (S). The rectilinear lengths of said zigzag path are horizontal and said liquid-based treatments on the tows (S) are carried out in horizontal treatment trays (4) of the spillway type.

14 Claims, 4 Drawing Sheets

(56) References Cited

U.S. PATENT DOCUMENTS

| | | | | |
|---|---|---|---|---|
| 9,677,196 | B2 * | 6/2017 | Rovellini | D01D 5/16 |
| 2001/0044341 | A1 * | 11/2001 | Henkel | F16D 3/205<br>464/111 |
| 2014/0151914 | A1 * | 6/2014 | Rovellini | D01D 10/0454<br>425/66 |
| 2015/0292120 | A1 * | 10/2015 | Lewis | B29C 48/919<br>425/67 |
| 2015/0292127 | A1 * | 10/2015 | Kamada | D01D 5/16<br>28/245 |
| 2017/0107645 | A1 * | 4/2017 | Rovellini | F16C 13/02 |
| 2022/0112628 | A1 * | 4/2022 | Hagström | C08B 16/00 |

* cited by examiner

COMPACT MODULE FOR THE WET SPINNING OF CHEMICAL FIBRES

CROSS REFERENCE TO RELATED APPLICATION

This application takes priority from and claims benefit to Italian Patent Application No. 102020000005230 filed on Mar. 11, 2020, the contents of which are herein incorporated by reference.

BACKGROUND OF THE INVENTION

Field of the Invention

The present invention relates to a module for the wet spinning of chemical fibres. In particular, the invention refers to a module of this type having a particularly compact layout, suitable for the spinning of a reduced number, for example from 2 to 8 and preferably from 4 to 6 low-count tows of chemical fibre filaments, among which artificial fibres such as rayon and lyocell or synthetic fibres such as acrylic fibres (PAN), meta aramidic fibres (NOMEX®) and para-aramidic fibres (KEVLAR®, TWARON®) meant for use in the textile industry or in the technical textile field or even, in the case of acrylic fibres, as precursors in the production of carbon fibres.

Description of the Related Art

In-Line Spinning Processes

In the production of chemical fibres, spinning processes can be substantially divided into two large families, in-line processes with horizontal development and in-line processes with vertical development.

In in-line processes with horizontal development many parallel tows are processed (from 6 up to 240, depending on their count) each one consisting of a remarkably varying number of filaments (from 30 up to 400,000), normally with a rather low speed (up to 500 m/min). As a matter of fact, these are processes used mainly in the spinning of non-meltable materials, and in particular in the production of acrylic or modacrylic fibres, which become spinnable by means of dissolution in suitable solvents and subsequent extrusion of the spinning solution within a suitable aqueous solution which causes the coagulation thereof by solvent removal; moving the filaments being formed within the aqueous coagulating solution is a particularly critical step, which hence strongly limits the maximum speed of the process.

In this type of processes a relatively low processing speed is used also to lower the risk of instability and breaks of the tows being processed. As a matter of fact, precisely due to the horizontal and close arrangement of the tows, any break of a tow causes a disturbance on all the adjacent tows, often leading to the need for halting the processing on the entire line, with a significant damage to production.

In in-line processes with typically modular, vertical development—but also in simply modular processes without a large height extension, as in the case (not very widespread) of continuous yarn spinning of rayon—a much lower number of tows for each module (up to 12) is instead processed, each having a markedly lower number of filaments than that seen above for the horizontal processes (for example up to 300), however with a much higher processing speed (up to 6,000 m/min). High overall production capacities can nevertheless be obtained also with this type of process, using multiple spinning assemblies (up to 96 in line in the case of the POY yarn) serving a single spinning line. This second type of processes is generally used in the spinning of thermoplastic fibres which solidify very fast by cooling and hence allow a spinning process at much higher speed without impairing the integrity of the individual filaments. Naturally, the higher speed implies in these processes a greater likelihood for breaks because the spinning process at high speeds becomes in any case more critical; however, any break of a single tow in this case does not damage but the few adjacent tows.

In substance, with reference for example to the rayon technology, horizontal lines are known which produce 160 continuous tows of 170 deniers, each one consisting of 80 filaments. The break of a tow and the resulting discontinuing of the same before reaching the desired length can result in halting 160 reels which are classified as second choice as being incomplete, with a high economic loss. Often, to collect a complete reel a whole day is required and hence a whole day's production of reels is declassed.

It is known that the same amount and type of tows can instead be produced by 40 4-tow modules, for a total of 160 tows collected in 4 reels for each module. In case of break of a single tow, at most further 3 adjacent ones are affected, so declassing only 2.5% of the daily production instead of 100% for the case examined above.

In case the spinning process is meant to produce large fibre tows, the production capacity of a horizontal-development line can reach, in the case of production of acrylic or modacrylic fibre, over 20,000 tons/year with 900 ktex of total count of the produced fibre, divided into tows up to 150 ktex each.

If instead a similar, quite costly line layout is used to produce much smaller tows, such as the smallest commercial standard 1K (1,000 filaments) tow having about 900/1550 dtex count of the precursor acrylic fibre of the carbon fibre—which dimension is particularly in demand in some specific technical applications, such as for example in the aeronautical industry—the capacity of the line can be remarkably reduced, up to about 60 times. As a matter of fact, in a horizontal line, maximum 1.8 metres wide due to process reasons, no more than a hundred tows can be housed; the overall count produced will hence be about 15 ktex. Moreover, the break of a single tow can cause, in particular conditions, the need to halt the plant with the interruption of dozens and dozens of further tows. The production of small-sized tows is hence utterly anti-economical in an in-line production plant with horizontal development of the conventional type.

Module Spinning Process

The problem of the inexpensive production of small-sized tows has been dealt with successfully by WO2013/014576, in the name of the same Applicant, wherein as a matter of fact a spinning process employing modules is disclosed, wherein each module deals with a small number of tows, for example from 2 to 8 tows, causing them to move according to rectilinear zig-zag paths which develop on the height of each individual module, between the drive rollers and the diverter rollers pivoted on the module walls. During these paths, the yarns undergo all the subsequent required washing, finishing, and stretching treatments, until obtaining the final yarn. The desired plant productivity is obtained juxtaposing in series a sufficiently large number of individual adjacent modules and collecting the yarn tows coming out from each of them into a single ribbon of large width to be sent directly to the oxidation and carbonisation process.

The total productivity of this type of process can, as already stated, be adjusted at will, by simply adding the necessary number of modules to the plant. The special layout of this process therefore makes up a marked discontinuity in the conventional layout of spinning lines of acrylic fibre, for textile use or as precursor for carbon fibre, compared to which it has remarkable advantages in terms of flexibility and space occupation when it is operated in the production of low-count yarns.

Problem at the Base of the Invention

Despite the remarkable advantages offered by the module spinning process disclosed by patent WO2013/014576 in manufacturing tows of yarns having a low count, as recalled above, such process also has some drawbacks which have so far limited the application thereof to the production of PAN fibres as precursors to produce carbon fibres.

A first drawback is connected to the conventional mode of performing the washing and finishing treatments on fibre tows which, in this document, is suggested for the washing/finishing devices arranged along the rectilinear lengths of the zig-zag path on the spinning module. As a matter of fact, this mode consists in deviating the path of the tows within a treatment tray by means of a first pair of entry rollers and to cause them then to go out from the same tray by means of a second pair of rollers, while inside the treatment tray an upstream flow of the washing fluid is maintained by gravity, thanks to a suitable slope of the treatment tray, so that the upward dragging effect induced by the tows slows down the downward movement of the washing solution by gravity.

This type of conventional solution implies some negative effects. Firstly, the abrupt deviation imposed by the pairs of entry and exit rollers, due to the necessarily small diameter thereof, give rise to high localised stresses on the tows in transit, which stresses can cause anisotropies of the individual filaments and hence impair their quality. Secondly, the pairs of entry and exit rollers make up a series of obstacles which slow down and remarkably complicate the operation of tow drawing-in. A last negative effect lies in the fact that the inclined arrangement of the zig-zag paths, which is essential for providing the hydraulic head necessary for the washing devices, takes up a larger vertical space, thus increasing the overall height of the spinning module.

A second drawback of known spinning modules is instead connected to the winding mode of the tows onto the corresponding drive rollers which—due to a well-known technical requirement in the drawing-in step—must always start from the bottom of the roller and then develop towards the top of the same. In known spinning modules, to obtain this winding mode, subsequent drive rollers are arranged in progressively offset positions toward the outside, in respect of a horizontal direction, so that the tows coming out from the top of a previous roller are aligned at the base of the subsequent roller. This arrangement hence heavily affects the overall width of the spinning module and hence, indirectly, the plant productivity, the occupied area being equal. On the other hand, when trying to limit to a minimum the widening of the module, by employing a winding of a single complete coil of the tow on the drive rollers and respective diverter rollers, an effective stretching action along the zig-zag paths would be impaired, where it is noticed that a single winding on the drive rollers is not normally sufficient to impose, without sliding, significant speed variations between two consecutive drive rollers.

The problem at the base of the present invention is hence that of identifying a more compact spinning module in respect of known-art spinning modules, both in terms of width and height, and that moreover does not provide sudden tow deviations in the zig-zag paths between the drive rollers, in correspondence of the washing and finishing devices.

SUMMARY OF THE INVENTION

In the frame of this general problem, a first object of the invention is to provide a washing device which does not provide tow diverter rollers in the treatment trays.

A second object of the invention is to provide a washing device which can be installed in a horizontal position, to take up a smaller space in a vertical direction and hence reduce the overall height of the spinning module.

Finally, a third object of the invention is to change the tow path on the drive rollers to make it possible to assembly such drive rollers in a perfectly overlapped position instead than in an offset position in a horizontal direction, to render as low as possible the space occupied by said rollers in a horizontal direction and hence reduce the overall width of the spinning module.

This problem is solved, and these objects are achieved by means of a compact wet spinning module having the features defined in claim 1. Other preferred features of such spinning module are defined in the dependent claims.

BRIEF DESCRIPTION OF THE DRAWINGS

Further features and advantages of the compact spinning module according to the present invention will in any case be more evident from the following detailed description of a preferred embodiment of the same, provided purely as a non-limiting example and illustrated in the attached drawings, wherein.

DETAILED DESCRIPTION OF THE SEVERAL EMBODIMENTS

According to the present invention, to solve the above highlighted problem, a compact spinning module is suggested wherein the zig-zag path of the tows among the drive rollers provides horizontal rectilinear lengths among subsequent drive rollers and wherein the treatment or finishing trays arranged along said path are of the spillway type, so as to require no tow deviation with respect to the rectilinear path thereof from a drive roller to the subsequent one.

Moreover, all drive rollers are pivoted on a same vertical support plate, and are hence perfectly overlapped in a horizontal plane, while the deviation of outgoing tows from the top of a roller towards the bottom of the subsequent roller is obtained by changing the inclination of the axis of the drive rollers and of the corresponding diverter rollers with respect to a direction perpendicular to the support plate.

General Layout

Figure 1:
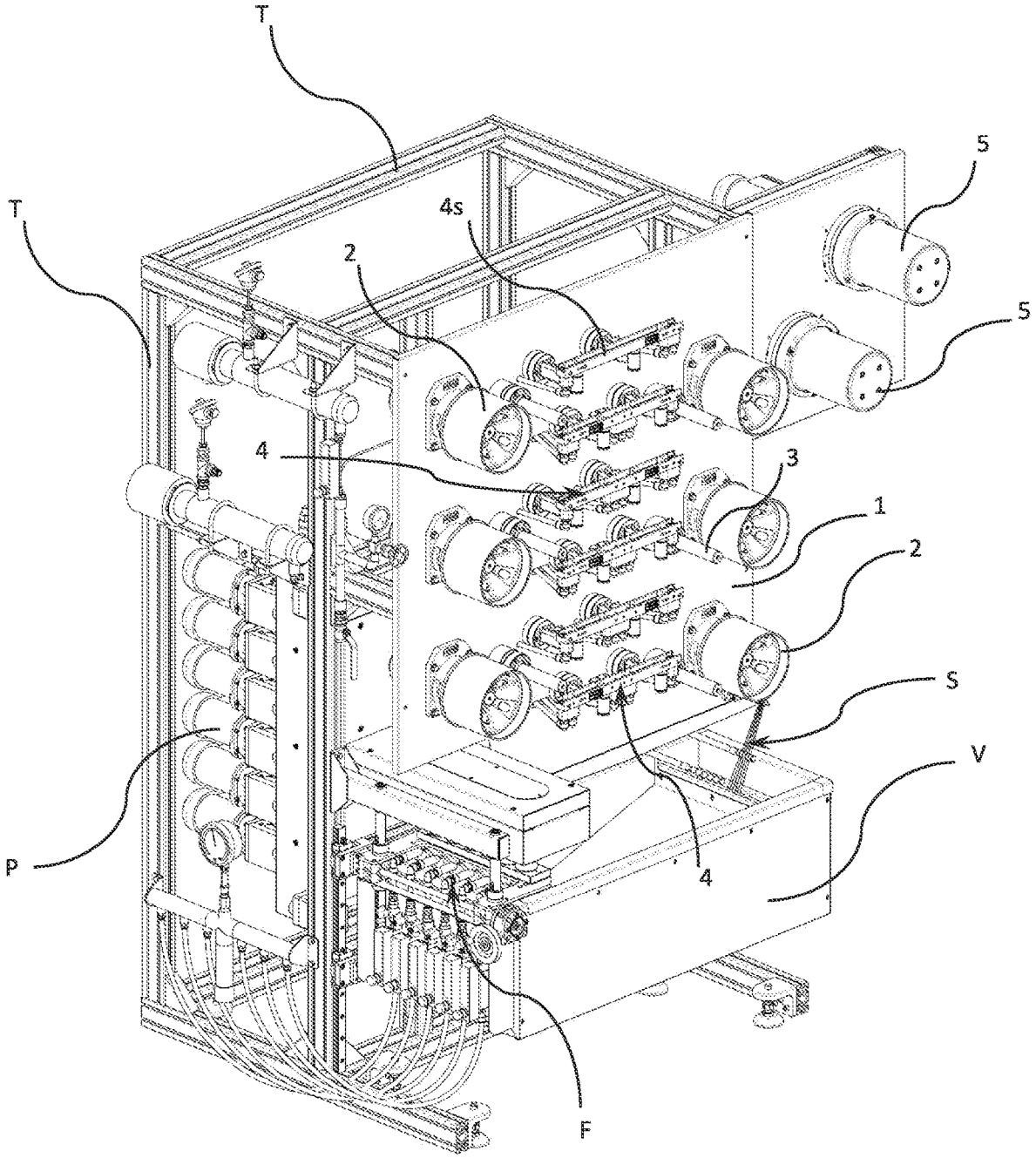
FIG. 1 is a perspective overall view of the compact spinning module according to the present invention.
Figure 2:
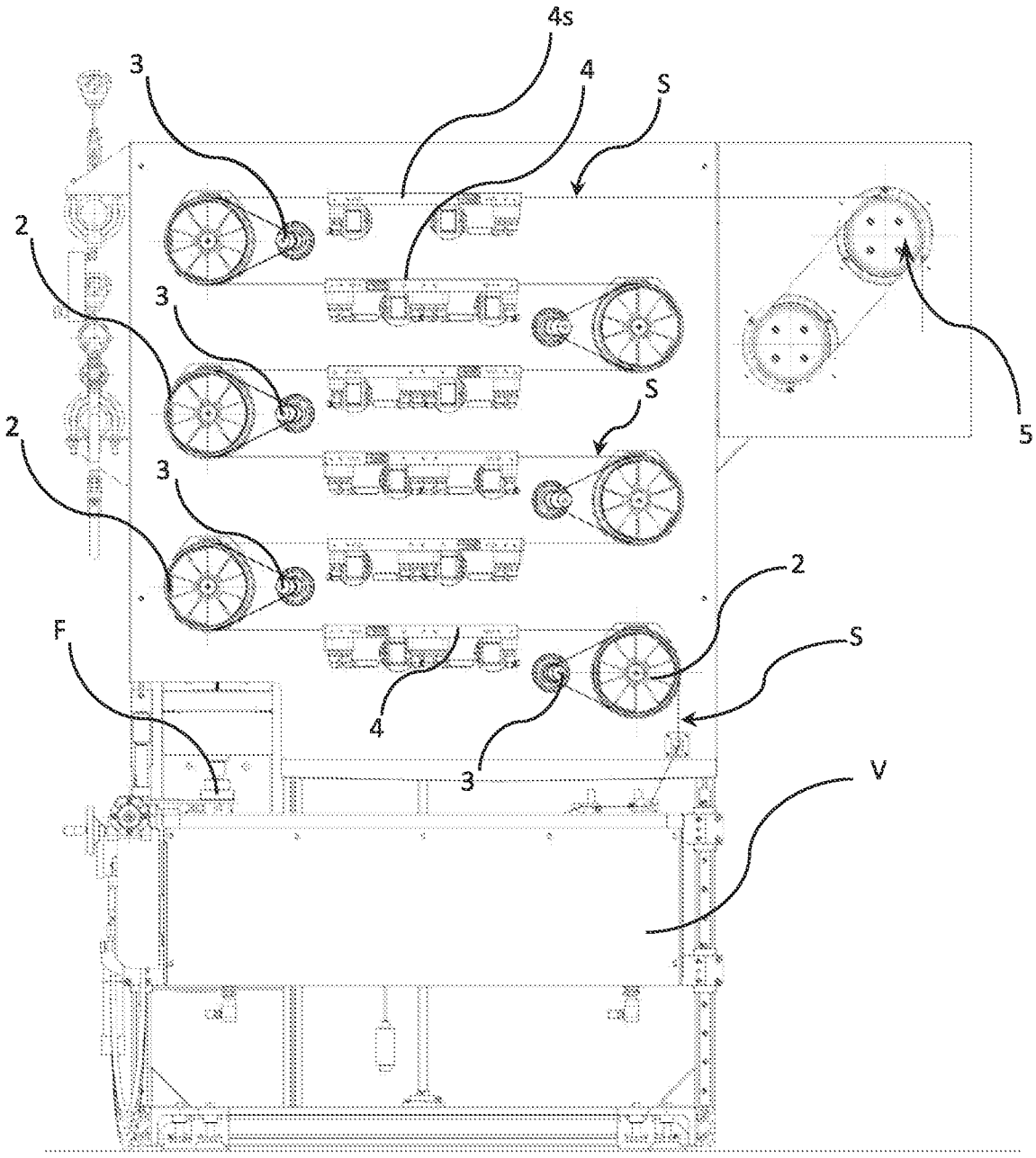
FIG. 2 is a front view of the compact spinning module of FIG. 1.
Figure 3:
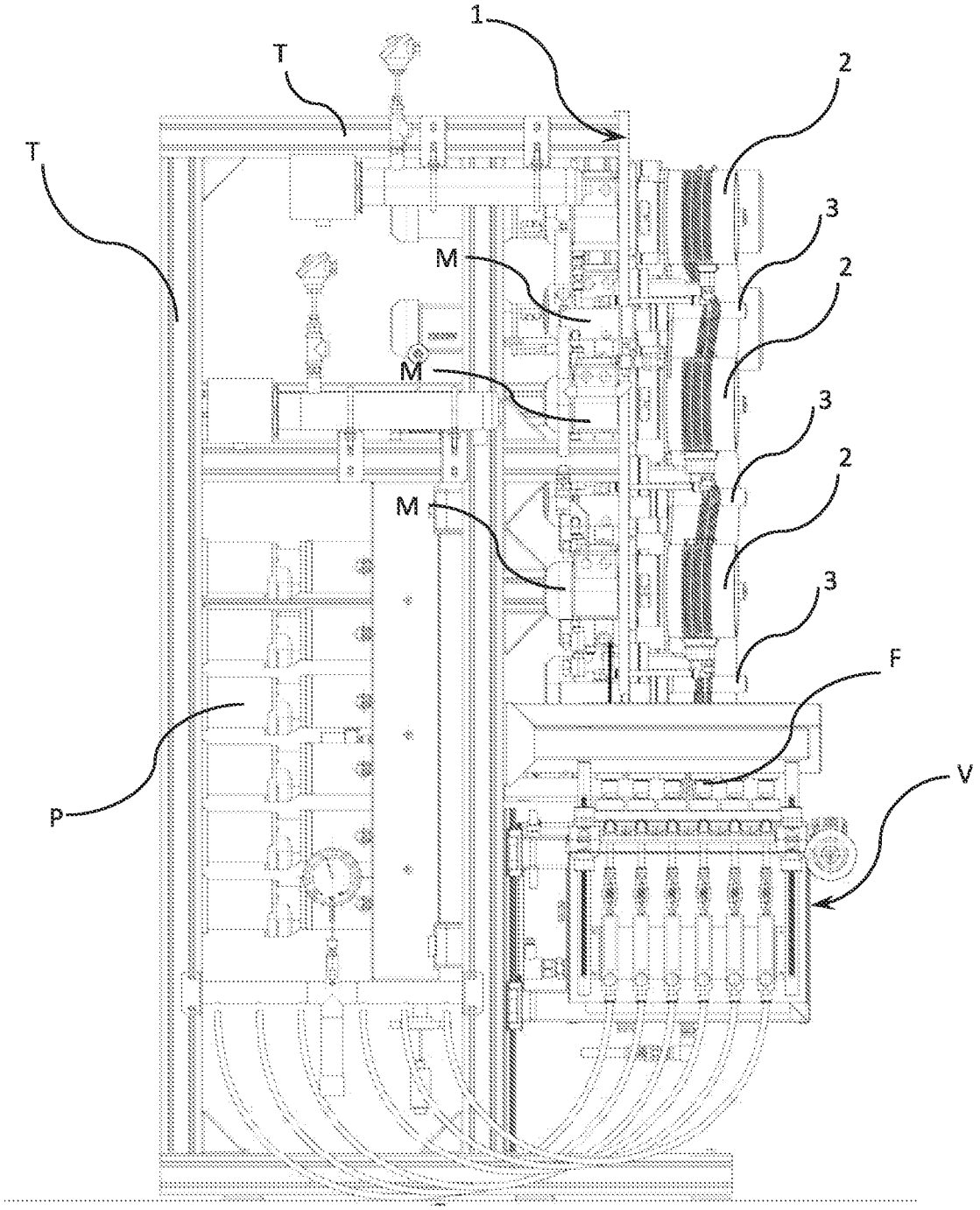
FIG. 3 is a side view of the compact spinning module of FIG. 1.

The general layout of the compact spinning module according to the present invention is clearly illustrated in FIGS. 1-3 and comprises a sturdy reticular frame T, consisting of steel crossmembers mutually welded or bolted, whereto the functional elements of the module are fastened. Said functional elements comprise a spinning head F which turns out a limited number, from 2 to 8 and preferably from 4 to 6 low-count tows S consisting of continuous filaments, corresponding supply pumps P of the spinning solution and a coagulation tank V containing the coagulation solution. From coagulation tank V the tows S of spun and coagulated filaments come out, which tows must be subsequently processed in aqueous washing and finishing solutions to obtain the removal of the solvent and impart the filaments the desired qualities.

According to the invention, for this purpose, tows S are sent onto a series of drive rollers 2 and corresponding diverter rollers 3 which are all pivoted on a same vertical support plate 1, integral with frame T, aligned onto two respective vertical lines, in the proximity of the two opposite vertical sides of said support plate 1. Drive rollers 2 are arranged to determine a zig-zag path of tows S which develops on the entire extension of support plate 1. According to a first important feature of the present invention, the individual lengths of such path are arranged in overlapping horizontal planes, which means, in other words, that drive rollers 2 are arranged on plate 1 so as to have the upper edge of a drive roller 2 at the same height as the lower edge of a subsequent drive roller 2, thus optimising the use of the available space on plate 1, as clearly visible in FIGS. 1 and 2. Diverter rollers 3 are arranged next to each respective drive roller 2, have a smaller diameter, and are idly pivoted onto the same support plate 1. Diverter rollers 3 are used, in a manner per se known, for forming a winding of one or more coils of tows S on drive rollers 2, s to increase the friction force which each drive roller 2 can impart onto the tows S being processed.

Along the above-said horizontal lengths of the zig-zag path, which extend between pairs of successive drive rollers 2, treatment trays 4 provided with lateral spillway are housed, within which the washing and finishing of tows S are performed. In the embodiment illustrated in the drawings there are provided six drive rollers 2 and an equal number of treatment trays 4; each of such treatment trays 4 is arranged in a perfectly horizontal manner and aligned with the upper edge of previous drive roller 2 (wherefrom tows S are delivered) and with the lower edge of subsequent roller (where tows S are received). The last treatment tray 4*s*, arranged in a higher position on support plate 1, is instead followed by a pair of stretching rollers 5, housed on a lateral extension 1*a* of the support plate 1. Stretching rollers 5 determine the final spinning speed of tows S and supply the same to an underlying winding machine (not shown) for collection onto spools, in a manner known per se, of tows S made of by now fully treated fibres.

Alternatively, when the treated fibre is a PAN fibre meant to be used directly as a precursor to produce carbon fibre, the tows S coming out from stretching rollers 5 are treated in an underlying vertical steam stretching device and then sent directly and continuously to the oxidation and carbonisation plants, in the way already taught in the cited patent WO2013/014576.

Drive Rollers and Orientable Diverter Rollers

According to another feature of the invention, in order to be able to obtain the desired winding of tows S onto drive rollers 2 and onto the respective idle diverter rollers 3, starting from the base and towards the free top of such rollers—despite the fact that all these drive rollers 2 and diverter rollers 3 are pivoted onto a same vertical plane consisting of the support plate 1—it is provided that the attitude of the axes of drive rollers 2 and diverter rollers 3 be laterally adjustable within a preset angle with respect to the direction perpendicular to support plate 1, up to a maximum inclination of 10°, while such axes always lie in a horizontal plane. As a matter of fact, during the tests carried out the Applicant was able to ascertain that it is possible to obtain a very stable layout of tows S being wound onto drive rollers 2—despite the fact that such tows S move into an inclined direction with respect to support plate 1, when they run from the top of a drive roller 2 to the bottom of the subsequent drive roller 2—only when the axis of the receiving drive roller 2 is oriented so as to be perpendicular to the receiving direction of tows S. At the same time, the axis of each diverter roller 3 must be convergent with respect to the axis of the respective drive roller 2, in a moving-away direction from support plate 1, to cause a winding with subsequent suitably distanced coils of tows S on the surface of drive rollers 2, as clearly illustrated, in a schematic way, in FIGS. 3, 4 and 5.

The adjustability in the horizontal plane of the lateral inclination of the axes of drive rollers 2 and of the respective diverter rollers 3, i.e. the axes attitude, is preferably obtained by means of cylindrical joints (not shown in the drawings) which allow the adjustment of the axis attitude when the joint is in a loose position and they maintain instead the axis in a preset inclination when the joint is tightened. It is hence clear that the pivoting of drive rollers 2 and of diverter rollers 3 onto support plate 1, which has been mentioned in the introductory portion, does not occur directly onto said plate 1, but rather through the above-said cylindrical joints, the external half-joint of which is integral with support plate 1, while the internal half-joint indeed carries the pivots of said rollers 2 and 3. Advantageously, the motors M which drive into rotation drive rollers 2 are rigidly connected to the latter ones on a same axis and it is hence the whole motor M/drive roller 2 assembly which oscillates laterally about the pivot housed in the respective supporting cylindrical joint.

Two-Step Treatment Tray

Figure 4:
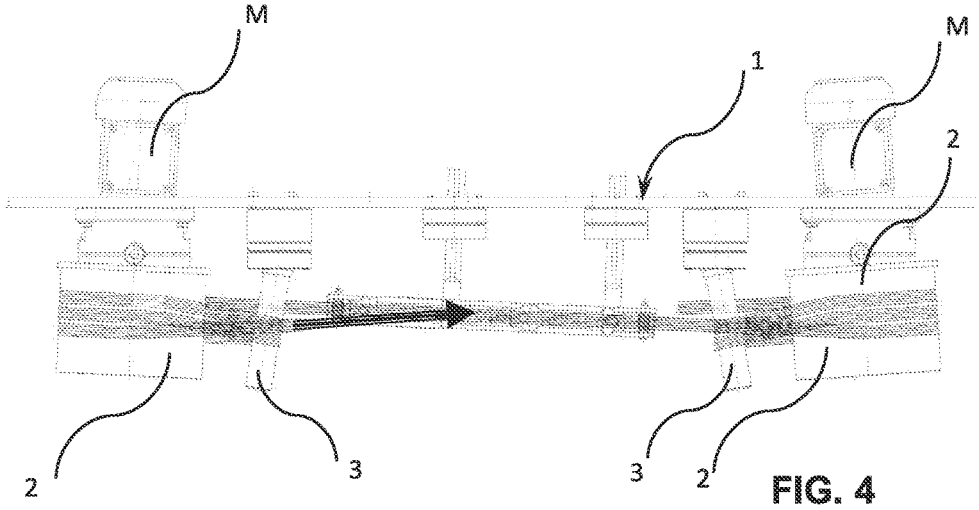
FIG. 4 is an enlarged-scale top view of a first treatment tray and of the respective supply rollers, which illustrates the path of the tows being processed.
Figure 5:
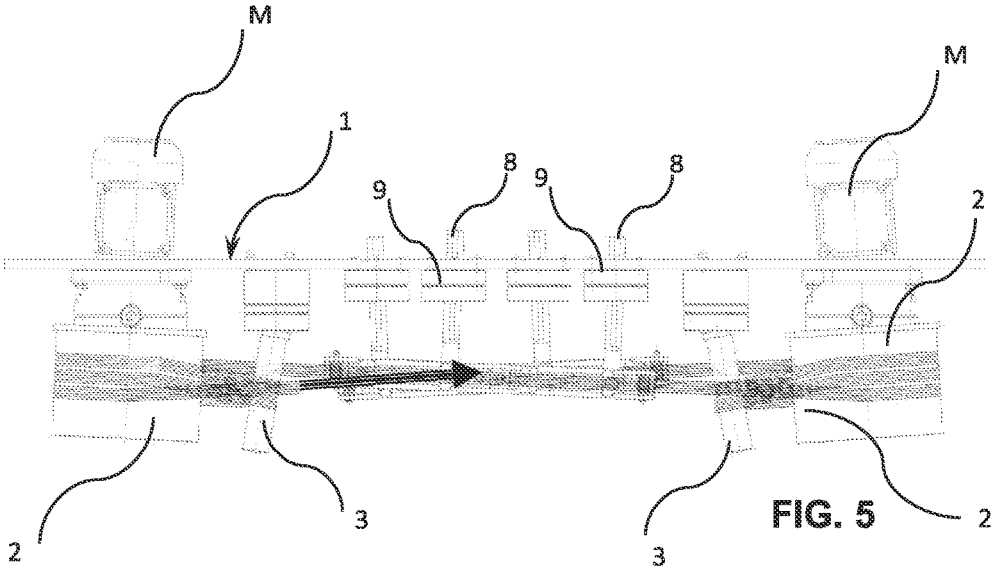
FIG. 5 is an enlarged-scale top view similar to FIG. 4, which illustrates in addition also a second underlying treatment tray, having an opposite inclination to the first treatment tray, in relation to a support plate of the drive rollers.
Figure 6:
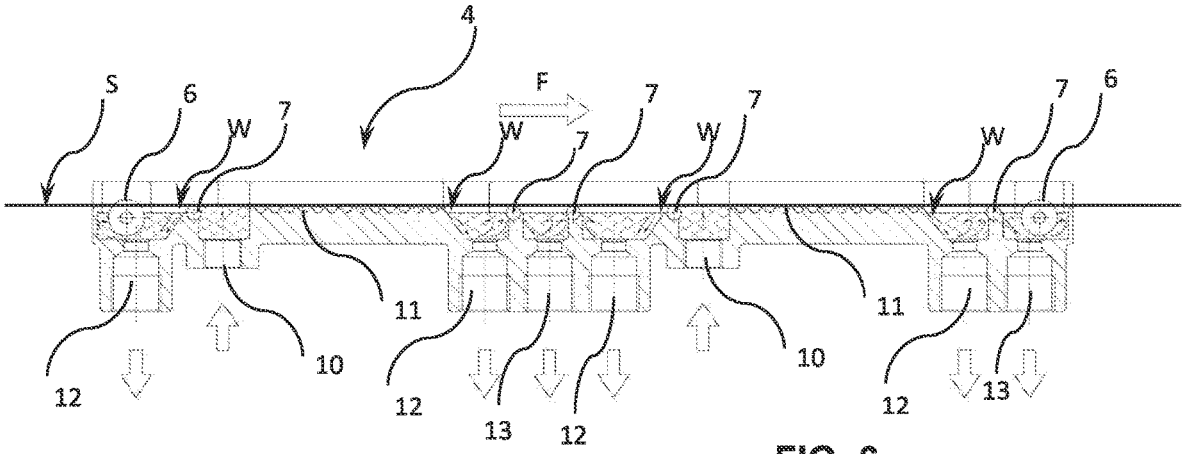
FIG. 6 is a further enlarged cross-section view of a two-step treatment tray according to the present invention.

The structure of treatment trays 4 is illustrated in detail in FIG. 6 where a schematic cross-section view thereof is shown, while the fastening system of treatment trays 4 to support plate 1 is clearly shown in FIGS. 4 and 5.

Treatment trays 4 have been designed for allowing the treatment of tows S with an aqueous solution for washing, extracting the solvent and/or finishing (in the following also referred to as simply "washing solution" or "treatment solution" or "treatment liquid" for simplicity's sake), which washing solution is supplied to a washing area 11 provided with two opposite spillways W, wherein tows S can hence be evenly wetted by the aqueous treatment solution, without the need to impart them any deviation with respect to the rectilinear and horizontal length between two subsequent drive rollers 2 of the above-said zig-zag path of tows S.

More in particular, in the preferred embodiment illustrated in FIG. 6 each treatment tray 4 comprises two subsequent washing steps, each of which consists of:

an inlet 10 of the washing solution;

a washing area 11, provided with two opposite lateral spillways W, the bottom of which has a surface finish apt to aid the turbulence of the washing solution in transit;

two main outlets 12 of the washing solution, which collect the washing solution coming from the two opposite spillways; and finally an additional outlet 13 of the washing solution, which collects the dripping coming from the tows S coming out from the washing area 11, and which is arranged immediately downstream of each main outlet 12, in the advancement direction of tows S represented by arrow F.

During the path within treatment trays 4, tows S are guided by inlet and outlet rollers 6, possibly grooved to offer an exact guide to tows S, and they can moreover possibly rest on cylindrical supports 7 when the tows take up a deformed pattern due to the wetting by the washing solution. The cylindrical supports 7 aid also the dripping of tows S when they come out of spillways W. It is worthy to notice that rollers 6 and cylindrical supports 7 do not alter the natural rectilinear path of tows S, and hence apply onto the same very low stresses, sufficient for maintaining tows S perfectly centred onto treatment trays 4 without determining any filament deterioration.

Inlets 10 and outlets 12-13 are connected to respective supplies and returns and to respective actuation pumps by means of a flexible pipe circuitry (not shown), and this circuitry is adjusted so that the fresh treatment solution is sent to a first washing area 11 of a treatment tray 4*s* in a higher position on support plate 1 and, in succession, the treatment solution going out of a washing area 11 is supplied to the subsequent washing area, following a top-to-bottom order, counter-current with respect to the bottom-to-top travelling direction of tows S. Within each individual washing area 11, however, the washing operation is preferably accomplished, at least for the most part, in co-current with respect to the direction of said tows S. As a matter of fact, in the contrary case, the high dragging effect of moving tows S on the washing solution would hinder an even flow of said washing solution in the desired direction.

The correct positioning of a treatment tray 4 on support plate 1 is determined by the interaction between two rigid arms 8 projecting from the lower part of treatment tray 4 and hinged to the same and two angular joints 9 integral with support plate 1. Each angular joint 9 is mounted in correspondence of a hole on plate 1 and is equipped in turn with a through-cavity wherein a rigid arm 8 can be housed and tightly fastened. When angular joints 9 are loosened, the rigid arms 8 of a treatment tray 4 can be differently displaced and angled in their seats to change the position of treatment tray 4 with respect to support plate 1 until said plate overlaps exactly the zig-zag path of tows S in the specific path length considered; once this position has been determined, the tightening of angular joints 9 securely locks treatment tray 4 in the desired position. During this adjustment it is of course not necessary to perform any change of the hydraulic connections of treatment tray 4 which, due to their flexibility, can follow treatment tray 4 in its movements.

From what has been set forth above it will furthermore be noticed that treatment trays 4 have a different layout depending on the side where they receive the tows; they hence have the layout illustrated in FIG. 6 when they receive the tows from the left hand-side, for an observer looking at the compact spinning module of the invention, and instead a fully specular layout when they receive tows S from the right hand-side.

Finally, precisely due to the arrangement of tows S on the drive rollers 2 already illustrated further above, treatment trays 4 have an inclination with respect to the vertical plane of support plate 1, with the tow-receiving end thereof which is arranged further away from support plate 1 (on the right-hand side in FIG. 4) and the tow-delivering end which is instead closer to support plate 1 (on the left-hand side in FIG. 4). However, since tows S invert their motion direction in the zig-zag path after each drive roller 2, it should be clear that treatment trays 4 are alternately inclined towards opposite sides, as schematically illustrated in FIG. 5, where, however, only two treatment trays 4 are shown for simplicity's sake.

In an alternative layout, useful for reducing the number of flexible hydraulic connections linked to treatment tray 4, the terminal part of the supply pipes of washing areas 11 is advantageously formed within the rigid arms 8, using a sealed hinge device in the coupling between said rigid arms 8 and the body of treatment tray 4.

Advantages of the Compact Spinning Module of the Invention

From the preceding description it should be clear how the compact spinning module of the present invention has fully achieved all the set objects, hence fully solving the technical problem at the base of the present invention through a very simple and effective technical solution. As a matter of fact, the compact spinning module of the present invention has a high flexibility of use and allows easy adjustment to adjust the module to the spinning of fibres of different types, which require different spinning speed, stretching conditions and types of treatment, hence remarkably widening the field of use of the same. As a matter of fact, it is possible to easily increase or decrease the number of coils of the winding of tows S on drive rollers 2 and relative diverter rollers 3, for example with a full coil or preferably with two full coils or even better with three full coils, depending on the stretching degree which it is wished to impart to tows S during the washing and/or finishing operations, in order to increase fibre density as the spaces previously taken up by the spinning solvent are left free. The position of treatment trays 4 can then be quickly adapted to different receiving and delivering positions of tows S on drive rollers 2, loosening angular joints 9 and directly dragging treatment trays 4 into a new correct position wherein tows S are carefully centred above treatment trays 4 across the entire extension thereof, while rigid arms 8 automatically adapt to the new position of treatment tray 4, sliding and changing their angular position in the housing cavity of respective angular joints 9.

The horizontal arrangement of the treatment paths between subsequent drive rollers 2 furthermore allows to reduce to the highest extent the height of the spinning module, while the arrangement of drive rollers 2 fully overlapped on one and the same single vertical support plate 1 allows to compact the width of said spinning module, thus reaching the desired object of providing an extremely compact spinning module, hence capable of significantly reducing the bulk with respect to conventional, horizontal-development lines.

Finally, the use of treatment trays 4 with washing areas provided with two opposite spillway allows to avoid abrupt deviations of the tows at the start and the end of each washing and finishing step, which allows to obtain a high quality of the obtained fibre as well as to make much simpler and faster the drawing-in operations of tows S at the beginning of the spinning process. Depending on the type of processed fibres, all the treatment trays 4 of the compact spinning module of the invention can then be entirely dedicated to the washing and solvent removal operations or they can be dedicated in part to this task and for the remaining part, for example the last two upper treatment trays or only the last one thereof, to fibre finishing treatments. Again, depending on the type of treated fibres, the treatment trays can all have two different treatment steps, such as the ones illustrated above with reference to the drawings, or instead also a single treatment step of a greater length, thus being suitable for different types of treatment in a highly flexible manner.

A further general advantage offered by the treatment trays 4 proposed in the spinning module of the present invention is finally that of using an extremely small volume of washing solution, so that it is possible to easily obtain particularly effective washing conditions, i.e. a high replacement speed of the washing solution, and an extremely fast change of the concentration or composition of the washing solution.

However, it is understood that the invention must not be considered limited to the special arrangements illustrated above, which make up only exemplifying embodiments thereof, but that different variants are possible, all within the reach of a skilled man in the art, without departing from the scope of protection of the invention, which is solely defined by the following claims.

What is claimed is:

1. Compact module for wet spinning of chemical fibres, of the type comprising a spinning head (F) of a limited number of tows (S), each one consisting of a plurality of continuous filaments, relative supply pumps (P) of the spinning solution, a coagulation tank (V) containing a coagulation solution, and a plurality of drive rollers (2) and respective idle diverter rollers (3) which determine a zigzag path of the tows (S) downstream of the spinning area, comprising rectilinear lengths along which liquid-based treatments are carried out on said tows (S);

wherein the rectilinear lengths of said zigzag path are horizontal and said liquid-based treatments on said tows (S) are carried out in horizontal treatment trays (4) of the spillway type;

wherein said treatment trays (4) comprise at least one washing area (11) provided with two opposite spillways (W);

wherein the tows (S) are evenly wetter by a treatment liquid supplied to said washing area (11), without imposing any diversion to said tows (S) with respect to the length of rectilinear and horizontal path between two drive rollers (2);

wherein each of said treatment trays (4) comprises at least one treatment step employing a treatment liquid, each of which is comprised of:

a said washing area (11) having two opposite spillways (Q), the bottom of which has a surface finish apt to aid the turbulence of the treatment liquid;

an inlet (10) of the treatment liquid into said washing area (11);

at least two main outlets (12) of the treatment liquid, which collect the treatment liquid coming from the two opposite spillways, respectively (W); and an additional outlet (13) of the treatment liquid, which collects the dripping from the tows (S) from the wash area (11), said additional outlet (13) being arranged immediately downstream of each main outlet (12), in the advancement direction (F) of the tows (S);

wherein said treatment tray (4) is fastened in an adjustable manner to said support plate (1) by means of rigid arms (8), projecting from the lower part of the treatment tray (4) and hinged thereto, which cooperate with respective angular joints (9), each one provided with a cavity wherein a corresponding rigid arm (8) is housed and tightened, said angular joints (9) being integral with the support plate (1) in correspondence of a hole on the same.

2. Compact module for wet spinning of chemical fibres as in claim 1, wherein the rectilinear lengths of said zigzag path of the tows (S) extend between the upper edge of a drive roller (2) and the lower edge of a subsequent drive roller (2).

3. Compact module for wet spinning of chemical fibres as in claim 2, wherein said zigzag path of the tows (S) comprises a winding of at least one full coil on each drive roller (2) and respective diverter roller (3).

4. Compact module for wet spinning of chemical fibres as in claim 3, wherein said drive rollers (2) and said diverter rollers (3) are all pivoted on a single vertical support plate (1).

5. Compact module for wet spinning of chemical fibres as in claim 4, wherein said drive rollers (2) and said diverter rollers (3) are aligned on two respective vertical lines, in the proximity of the two opposite vertical sides of said support plate (1).

6. Compact module for wet spinning of chemical fibres as in claim 5, wherein the attitude of the axes of said drive rollers (2) and of said diverter rollers (3) is adjustable in the horizontal plane in a preset angle around the perpendicular direction to said support plate (1).

7. Compact module for wet spinning of chemical fibres as in claim 6, wherein the adjustment range of the axis attitude of said drive rollers (2) and of said diverter rollers (3) is obtained by using cylindrical joints, the external half-joint of which is integral with the support plate (1) and the inner half-joint of which carries the pivots of said drive rollers (2) and diverter rollers (3), said cylindrical joints being able to be locked in any desired position.

8. Compact module for wet spinning of chemical fibres as in claim 7, wherein each of said drive rollers (2) is provided with a respective electric motor (M) rigidly connected thereto on a same axis, the whole motor (M)/drive roller (2) assembly being apt to oscillate sideways around the cylindrical joint which carries the pivot of said drive roller (2).

9. Compact module for wet spinning of chemical fibres as in claim 6, wherein each horizontal length of said zigzag path of the tows (S) has an inclined direction with respect to the support plate (1), from the upper edge of a delivering drive roller (2) to the lower edge of a subsequent receiving drive roller (2), and the axis of the receiving drive roller (2) is oriented, still in the horizontal plane, so as to be perpendicular to the above-said inclined direction of said horizontal length of the zigzag path of tows S.

10. Compact module for wet spinning of chemical fibres as in claim 9, wherein the axis of each diverter roller (3), still in the horizontal plane, is convergent with respect to the axis of the respective drive roller (2), in a moving-away direction from the support plate (1), to cause a winding with suitably distanced subsequent coils of the tows (S) on the surface of said drive roller (2).

11. Compact module for wet spinning of chemical fibres as in claim 1, wherein said treatment trays (4) have an inclined direction with respect to the vertical plane of the support plate (1), the receiving end of the treatment tray (4), receiving the tows (S), being further away from the support plate (1) than the release end of the same, releasing the tows (S), consistently with the corresponding inclined direction of the corresponding horizontal lengths of the zigzag path of the tows (S), said treatment trays (4) hence being alternately inclined on opposite sides in subsequent horizontal lengths of said zigzag path of the tows (S).

12. Compact module for wet spinning of chemical fibres as in claim 11, wherein said inlets (10), main outlets (12) and additional outlets (13) of the treatment liquid are connected to respective supplies, returns and circulation pumps by means of a flexible pipe circuitry, said circuitry being adjusted so that fresh treatment liquid is sent to a washing area (11) of a treatment tray (4*s*) in a higher position on the support plate (1) and, in succession, the treatment liquid coming out of a washing area (11) is supplied to a subsequent washing area (11), following a counter-current order with respect to the advancement direction of the tows (S) along said zigzag path.

13. Compact module for wet spinning of chemical fibres as in claim 12, wherein the end part of the supply pipes of the washing areas (11) is formed within said rigid arms (8).

14. Compact module for wet spinning of chemical fibres as in claim 1, wherein said tows S consist of artificial fibres, such as rayon and lyocell, or synthetic fibres such as acrylic, meta-aramidic and para-aramidic fibres.

* * * * *